US010867741B2

(12) United States Patent
Chen et al.

(10) Patent No.: US 10,867,741 B2
(45) Date of Patent: Dec. 15, 2020

(54) PSEUDO EDGE-WOUND WINDING USING SINGLE PATTERN TURN

(71) Applicant: HONEYWELL INTERNATIONAL INC., Morris Plains, NJ (US)

(72) Inventors: Keming Chen, Torrance, CA (US); Evgeni Ganev, Torrance, CA (US); William Warr, Glendale, CA (US)

(73) Assignee: Honeywell International Inc., Charlotte, NC (US)

( * ) Notice: Subject to any disclaimer, the term of this patent is extended or adjusted under 35 U.S.C. 154(b) by 281 days.

(21) Appl. No.: 15/997,842

(22) Filed: Jun. 5, 2018

(65) Prior Publication Data

US 2018/0286567 A1 Oct. 4, 2018

Related U.S. Application Data

(60) Division of application No. 15/096,028, filed on Apr. 11, 2016, now Pat. No. 10,062,497, which is a continuation-in-part of application No. 14/181,806, filed on Feb. 17, 2014, now abandoned.

(51) Int. Cl.

| | |
|---|---|
| ***H01F 7/06*** | (2006.01) |
| ***H01F 27/28*** | (2006.01) |
| ***H01F 41/12*** | (2006.01) |
| ***H01F 27/30*** | (2006.01) |

(52) U.S. Cl.

CPC ..... *H01F 27/2847* (2013.01); *H01F 27/303* (2013.01); *H01F 41/12* (2013.01); *Y10T 29/49073* (2015.01)

(58) Field of Classification Search

CPC ..... H01L 21/4853; H01L 24/11; H01L 2924/014; Y10T 29/49826; Y10T 29/49616; Y10T 29/49073; H05K 2203/0465; H05K 3/3468; B23K 1/00; B23K 31/02

USPC ..... 29/606, 602.1, 605, 609

See application file for complete search history.

(56) References Cited

U.S. PATENT DOCUMENTS

| | | | |
|---|---|---|---|
| 1,723,840 | A | 8/1929 | Burnham |
| 1,777,642 | A | 10/1930 | Harrington |
| 1,852,805 | A | 4/1932 | Frank |
| 3,069,766 | A | 12/1962 | Rush |
| 3,227,930 | A | 1/1966 | Hnilicka, Jr. |

(Continued)

FOREIGN PATENT DOCUMENTS

| | | | |
|---|---|---|---|
| CN | 102648503 | A | 8/2012 |
| CN | 202473571 | U | 10/2012 |

(Continued)

OTHER PUBLICATIONS

EP search report dated Aug. 4, 2015, application No. 15153688.5-1556.

(Continued)

*Primary Examiner* — Thiem D Phan

(74) *Attorney, Agent, or Firm* — Fogg & Powers LLC

(57) ABSTRACT

A winding system may include a plurality of metal plates including the same shape and size, such that the plates are stacked, and each of the plurality of metal plates is reversely positioned with respect to a gap pattern in an adjacent one of the plurality of metal plates. The plates are simultaneously brazed together while flow of molten brazing material is constrained by grooves formed on brazing tabs of the plates.

5 Claims, 6 Drawing Sheets

(56) References Cited

U.S. PATENT DOCUMENTS

| | | | | |
|---|---|---|---|---|
| 3,264,524 | A | 8/1966 | Dahlgren et al. | |
| 3,346,933 | A | 10/1967 | Lindsay | |
| 3,419,834 | A | 12/1968 | McKechnie et al. | |
| 3,732,514 | A | 5/1973 | Sato | |
| 3,832,661 | A | 8/1974 | Sato | |
| 4,367,450 | A | 1/1983 | Carillo | |
| 4,513,495 | A | 4/1985 | Kimberlin | |
| 4,524,342 | A | 6/1985 | Mas | |
| 4,649,639 | A | 3/1987 | Mas | |
| 4,689,594 | A | 8/1987 | Kawabata et al. | |
| 4,794,358 | A | 12/1988 | Steingroever et al. | |
| 4,902,998 | A | 2/1990 | Pollard | |
| 4,943,793 | A | 7/1990 | Ngo et al. | |
| 5,179,365 | A | 1/1993 | Raggi | |
| 5,984,164 | A * | 11/1999 | Wark | B23K 3/0623 228/164 |
| 6,114,932 | A | 9/2000 | Wester et al. | |
| 6,269,531 | B1 | 8/2001 | Mercado | |
| 6,445,272 | B1 | 9/2002 | Mercado et al. | |
| 7,071,807 | B1 | 7/2006 | Herbert | |
| 7,091,817 | B2 | 8/2006 | Peck et al. | |
| 7,126,451 | B2 | 10/2006 | Maruyama | |
| 7,498,921 | B1 | 3/2009 | Wang | |
| 7,701,316 | B2 | 4/2010 | Teng et al. | |
| 7,704,449 | B2 | 4/2010 | Kikuchi et al. | |
| 7,859,381 | B2 | 12/2010 | Chen et al. | |
| 7,884,695 | B2 | 2/2011 | Mosley | |
| 8,179,222 | B2 | 5/2012 | Lee et al. | |
| 8,301,266 | B1 | 10/2012 | Zilberman et al. | |
| 8,456,263 | B2 | 6/2013 | Jarkko | |
| 8,564,396 | B2 | 10/2013 | Pan | |
| 8,587,019 | B2 | 11/2013 | Yan et al. | |
| 2004/0257190 | A1 | 12/2004 | Peck et al. | |
| 2005/0046538 | A1 | 3/2005 | Maruyama | |
| 2006/0102594 | A1 | 5/2006 | Kikuchi et al. | |
| 2010/0117780 | A1 | 5/2010 | Hsieh et al. | |
| 2010/0253465 | A1 | 10/2010 | Yeh | |
| 2013/0285776 | A1 | 10/2013 | Piascik et al. | |
| 2015/0235756 | A1 | 8/2015 | Chen et al. | |

FOREIGN PATENT DOCUMENTS

| | | | |
|---|---|---|---|
| EP | 2230675 | A2 | 9/2010 |
| EP | 2899852 | A1 | 7/2015 |
| FR | 2424618 | A1 | 11/1979 |

OTHER PUBLICATIONS

China Intellectual Property Office, "Decision on Rejection from CN Application No. 2015100836997" from Foreign Counterpart to U.S. Appl. No. 14/181,806, dated Dec. 5, 2018, pp. 1 through 8, Published: CN.

China Intellectual Property Office, "First Office Action from CN Application No. 2015100836997", from Foreign Counterpart to U.S. Appl. No. 14/181,806, dated Sep. 15, 2017, pp. 1 through 9, Published: CN.

China Intellectual Property Office, "Second Office Action from CN Application No. 2015100836997", from Foreign Counterpart to U.S. Appl. No. 14/181,806, dated May 18, 2018, pp. 1 through 7, Published: CN.

U.S. Patent and Trademark Office, "Advisory Action", U.S. Appl. No. 15/096,028, dated Sep. 26, 2017, pp. 1 through 3, Published: US.

U.S. Patent and Trademark Office, "Final Office Action", U.S. Appl. No. 15/096,028, dated Mar. 12, 2018, pp. 1 through 10, Published: US.

U.S. Patent and Trademark Office, "Final Office Action", U.S. Appl. No. 15/096,028, dated Jun. 28, 2017, pp. 1 through 10, Published: US.

U.S. Patent and Trademark Office, "Interview Summary", U.S. Appl. No. 14/181,806, dated Dec. 15, 2015, pp. 1 through 3, Published: US.

U.S. Patent and Trademark Office, "Interview Summary", U.S. Appl. No. 15/096,028, dated Jan. 18, 2018, pp. 1 through 9, Published: US.

U.S. Patent and Trademark Office, "Interview Summary", U.S. Appl. No. 15/096,028, dated May 30, 2017, pp. 1 through 11, Published: US.

U.S. Patent and Trademark Office, "Interview Summary", U.S. Appl. No. 15/096,028, dated Jun. 14, 2017, pp. 1 through 3, Published: US.

U.S. Patent and Trademark Office, "Interview Summary", U.S. Appl. No. 15/096,028, dated Aug. 24, 2017, pp. 1 through 3, Published: US.

U.S. Patent and Trademark Office, "Notice of Allowance", U.S. Appl. No. 15/096,028, dated May 23, 2018, pp. 1 through 8, Published: US.

U.S. Patent and Trademark Office, "Office Action", U.S. Appl. No. 14/181,806, dated Nov. 6, 2015, pp. 1 through 14, Published: US.

U.S. Patent and Trademark Office, "Office Action", U.S. Appl. No. 15/096,028, dated Apr. 21, 2017, pp. 1 through 18, Published: US.

U.S. Patent and Trademark Office, "Office Action", U.S. Appl. No. 15/096,028, dated Nov. 9, 2017, pp. 1 through 11, Published: US.

U.S. Patent and Trademark Office, "Restriction Requirement", U.S. Appl. No. 14/181,806, dated Aug. 6, 2015, pp. 1 through 7, Published: US.

U.S. Patent and Trademark Office, "Restriction Requirement", U.S. Appl. No. 15/096,028, dated Jan. 13, 2017, pp. 1 through 7, Published: US.

* cited by examiner

PSEUDO EDGE-WOUND WINDING USING SINGLE PATTERN TURN

RELATED APPLICATIONS

This application is a divisional of U.S. patent application Ser. No. 15/096,028, filed Apr. 11, 2016, which is a Continuation-in-Part of U.S. patent application Ser. No. 14/181,806, filed Feb. 17, 2014, and all of which are incorporated herein by reference.

BACKGROUND OF THE INVENTION

Conventional edge-wound technology may use a flat-wire wound onto a bobbin. The wide edge may be placed vertically on a bobbin in order to obtain single layer design with a maximum number of turns. If only one layer is wound, this may improve the heat transfer to the environment or to a heat sink. A larger ratio between a wide edge and a narrow edge may result in increased power density of the device. However, there may be problems in fabricating a wire with such a high ratio of these dimensions. For example, the higher the ratio, the more difficult it may be to wind the wire around a rectangular bobbin.

In addition, windings may be subject to a minimal turn radius and thus, large voids between the wire and the core may occur that may result in power losses and difficulties in cooling the device.

Some of these issues may be resolved by constructing coils as stacked assemblies of electrically interconnected plates. However, fabrication of such stacked plate assemblies may require multiple fabrication steps. For example, each plate typically needs to be electrically connected to an adjacent plate at a specific connection point. Except for the connection points, surfaces of each plate may need to be electrically insulated from surfaces of adjacent plates. Thus fabrication of a coil from a stack of plates may require the performance of numerous successive and carefully controlled connection and insulation steps.

As can be seen, there is a need for a new method of creating windings around a bobbin or transformer core. More particularly, there is a need for a stacked plate winding which can be assembled without performing numerous successive electrical connection and insulation steps.

SUMMARY

In one aspect of the invention, an electrical coil comprises: a plurality of metal plates, wherein the plates have brazing tabs; wherein grooves are in surfaces of the brazing tabs, wherein the plurality of metal plates are in a stacked configuration and brazed together, with brazing material, at their respective brazing tabs; and wherein the brazing material does not extend beyond outer peripheries of the brazing tabs.

In another aspect of the invention, a plate for a stacked electrical coil comprises: a rim having a gap therein; a brazing tab positioned adjacent the gap and connected to the rim; and a plurality of grooves formed in the brazing tab.

In another aspect of the invention, a method for producing a winding, comprises: applying a brazing material to a brazing tab of a first metallic plate; positioning a second metallic plate so that a brazing tab of the second plate contacts the brazing material; simultaneously heating the metallic plates and the brazing material; and constraining flow of brazing material between adjacent ones of the brazing tabs.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Broadly, an embodiment of the present invention generally provides a winding for autotransformers, transformers, and inductors. More specifically, the present invention may provide a pseudo-edge-wound winding for autotransformers, transformers, and inductors using a single pattern metal sheet. Still further, the present invention may provide such a winding which may be assembled without a need to perform numerous successive electrical connection and insulation steps. For example, the invention may preclude a need to successively perform separate steps such as placing an insulating material on a first plate; followed by placing a second plate on the insulating layer, followed by soldering or brazing the first to the second plate; followed by repeated separate insulating and soldering or brazing steps for a successive collection of n plates.

Figure 1:
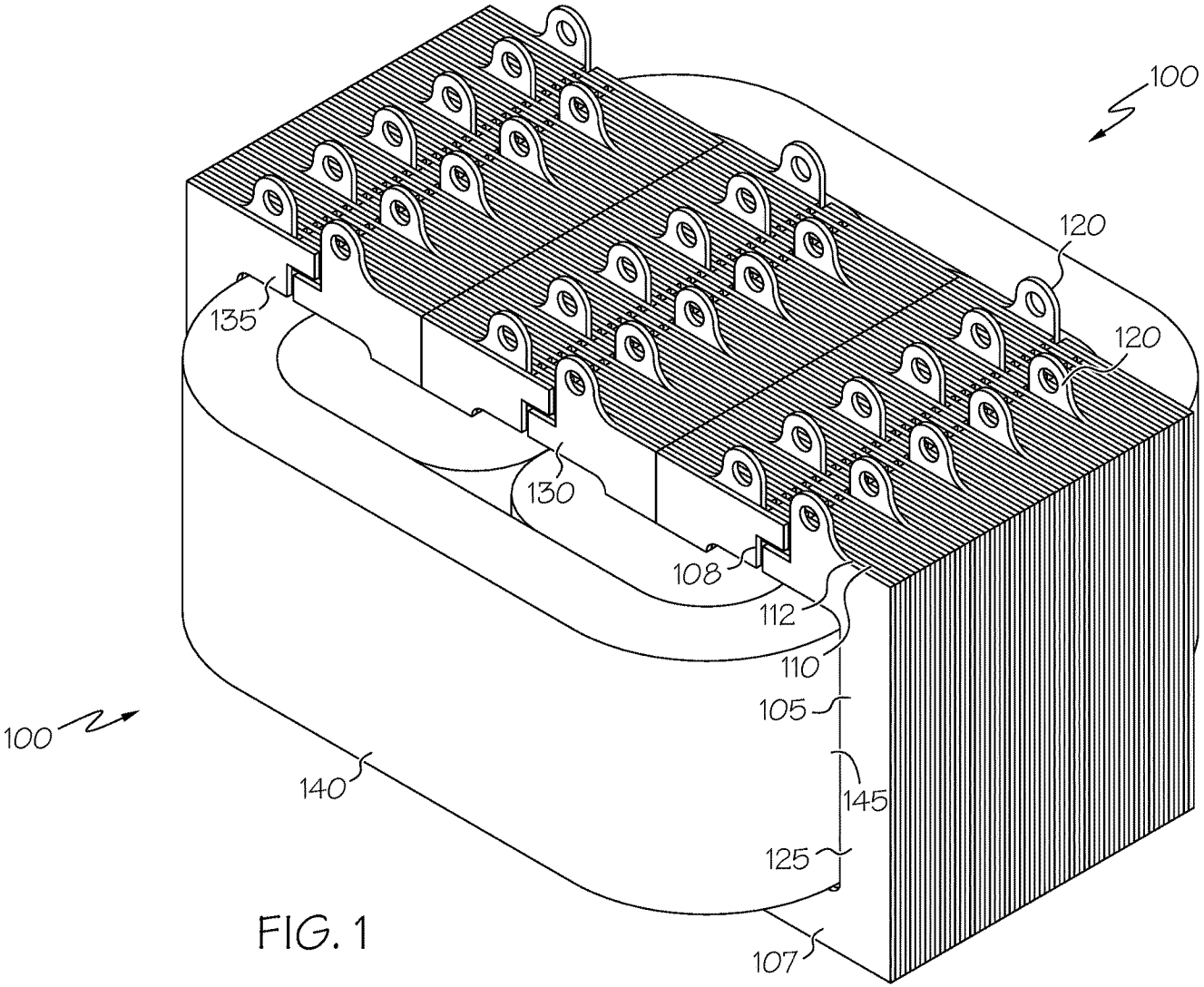
FIG. 1 illustrates a system of stacks of single pattern plates placed around a transformer core in accordance with an exemplary embodiment of the invention.

FIG. 1 illustrates a system 100 of a first stack 125 of plates, a second stack 130 of plates, and a third stack 135 of plates such that the plates are metallic plates of the same shape and size (referred to in general as stack 125, stack 130, and stack 135). A plate 105 may include a rim 107 encircling a hole 145. The plate may include a gap 108. A first brazing tab 132 may be is positioned on a first side of the gap 108. A second brazing tab 134 may be is positioned on a second side of the gap 108. A combined length of the first and second brazing tabs 132 and 134 may exceed a width of the gap 108. The plate 105 may include a lug 120. The plate 105 may be made of metallic material. The plate 105 may be electrically conductive and may be formed by a metal stamping process.

The stacks (125, 130, 135) may include a front plate 105 and a second plate 110 that are reversed with respect to each other with respect to a gap 108 in the plates (105, 110). The lugs 120 may extrude from one end 112 of the plate 105, and may allow for attachment to an external wire (not shown). The gap 108 in the plates may allow the plates to form one continuous conductor. Each of the plates in the stacks (125, 130, 135) of plates may be brazed together near the gap 108 so that the plates in the stacks (125, 130, 135) form a continuous electrical conductor. By alternating plates with respect to each other, the gap allows the plates to form a continuous loop from the front plate 105 plate to the second plate, by connecting the front plate to the second plate by brazing only at one point near the gap 108.

One of the plates in the stacks (125, 130, 135) may vary in size, shape, width, and thickness, and may be made of various material that conducts electricity. In an exemplary embodiment, the stacks (125, 130, 135) of plates may be made of aluminum, copper, or other conductors of electricity. In an embodiment, each of the plates in the stacks (125, 130, 135) of plates may be of a same shape and size. A transformer core 140 may be inserted through a hole 145 in the stacks (125, 130, 135) of plates.

Figure 3:
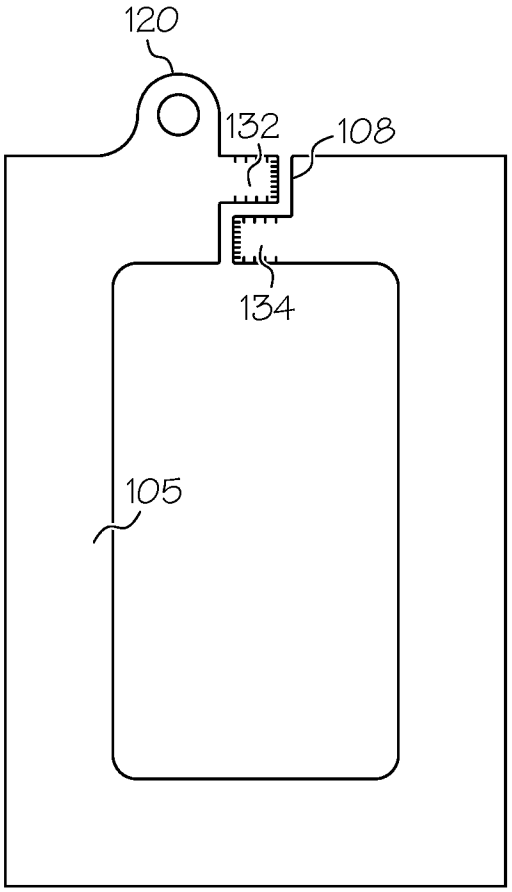
FIG. 3 shows a plate with a second configuration for use with the system of FIG. 1 in accordance with an exemplary embodiment of the invention.
Figure 2:
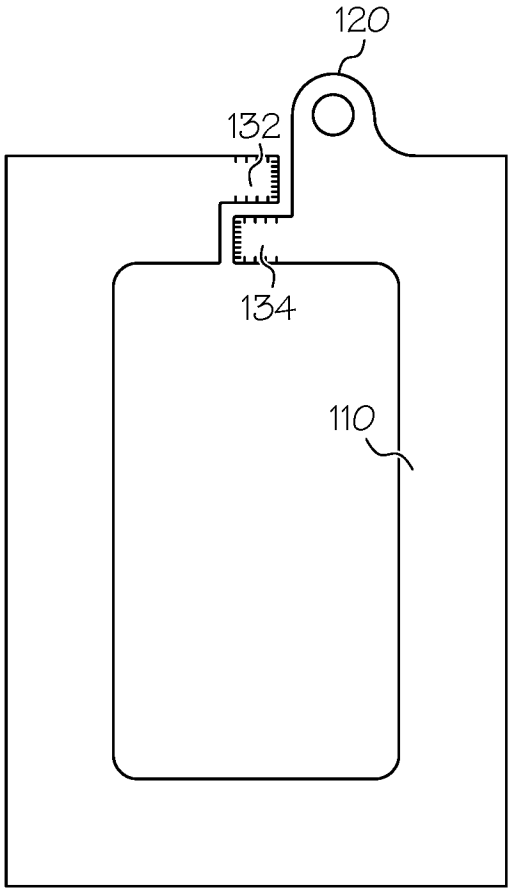
FIG. 2 shows a plate with a first configuration for use with the system of FIG. 1 in accordance with an exemplary embodiment of the invention.

FIGS. 2 and 3 illustrate the metallic plates 105 and 110 using single pattern turns. The plate 105 and the plate 110 may each have the same pattern except for position of a lug 120 for external electrical interface. The plates 105 and 110 may be electrically connected to one another by brazing the brazing tabs 131 together.

Figure 5:
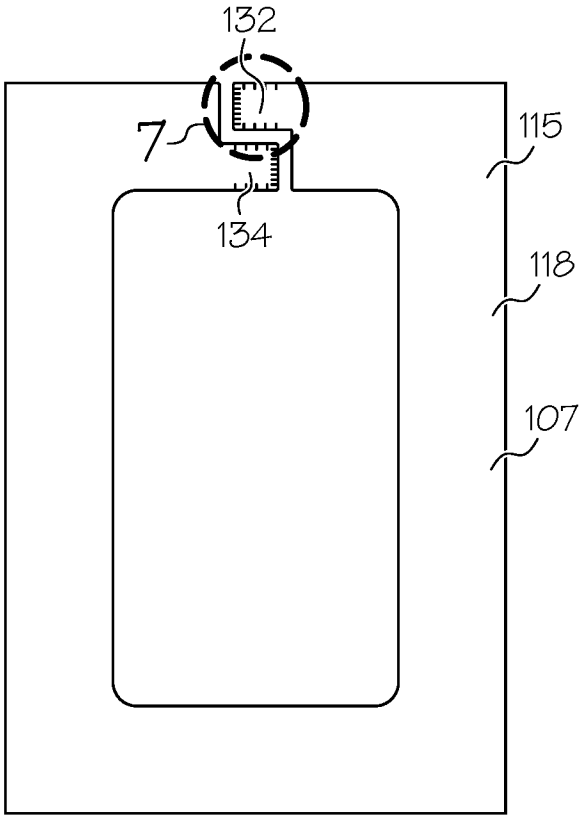
FIG. 5 shows a second side of the third plate for use with the system of FIG. 1 in accordance with an exemplary embodiment of the invention.
Figure 4:
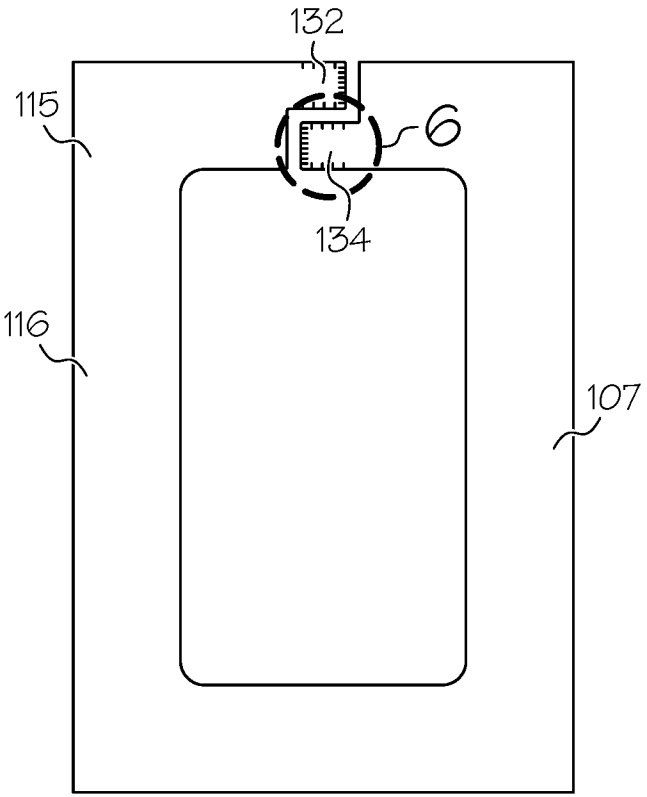
FIG. 4 shows a first side of a third plate for use with the system of FIG. 1 in accordance with an exemplary embodiment of the invention.

FIGS. 4 and 5 illustrate a third type of plate 115 which differs from the plates 105 and 110 in that it has no lug 120. A front side 116 of the plate 115 is illustrated in FIG. 4. A back side 118 of the plate 115 is illustrated in FIG. 5. It may be seen that two of the plates 115 may be positioned in an adjacent relationship so that the back side 118 of a first one of the plates 115 may be facing a back side 118 of a second one of the plates 115. With such positioning the brazing tabs 132 and 134 of the first one of the plates 115 may overlie the brazing tabs 132 and 134 of the second one of the plates 115 When the front side 116 of a third one of the plates 115 is positioned adjacent the front side 116 of another one of the plates 115, the brazing tabs 132 and 134 of the second and third one of the plates 115 may overlie one another. The brazing tabs 132 of the first and second plates 115 may be brazed together and the brazing tabs 134 of the second third plates 115 may be brazed together. When such brazing is complete, an electrical pathway may develop around the rim 107 of the first plate 115, through the brazing tabs 132 of the first and second plates 115, around the rim 107 of the second plate 115, and through the brazing tabs 134 of the second and third plates 115. Such electrical pathways may be extended by brazing successive ones of the plates 115 to one another with an alternating pattern in which front sides 116 of two of the plates 115 face one another and back sides 118 of a successive pair of the plates 115 face one another. It may be seen that the plates 115 may all be stamped from sheet material with the same shape. Thus fabrication costs of the plates 115 may be minimized.

Assembly of the stacks of plates may be advantageously performed by successively placing plates in a holding fixture (not shown) and positioning brazing film on one of the brazing tabs. After a desired number of the plates are positioned in the fixture, the entire fixture and stack of plates may be heated in a furnace so that the brazing film may become molten and metallurgical bonding may simultaneously develop between brazing tabs of adjacent plates.

While it is desirable to perform simultaneously brazing, there is a risk that molten brazing material may migrate away from desired locations between tabs of adjacent plates. For example, molten brazing material, if left unconstrained, may flow into contact with more than two of the brazing tabs. This might result in an electrical connection developing between non-adjacent plates.

Figure 7:
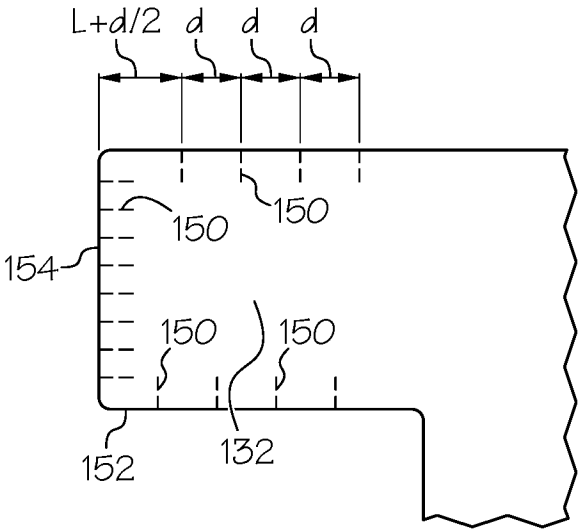
FIG. 7 shows a second detailed view of a portion of the third plate of FIG. 1 in accordance with an exemplary embodiment of the invention.
Figure 6:
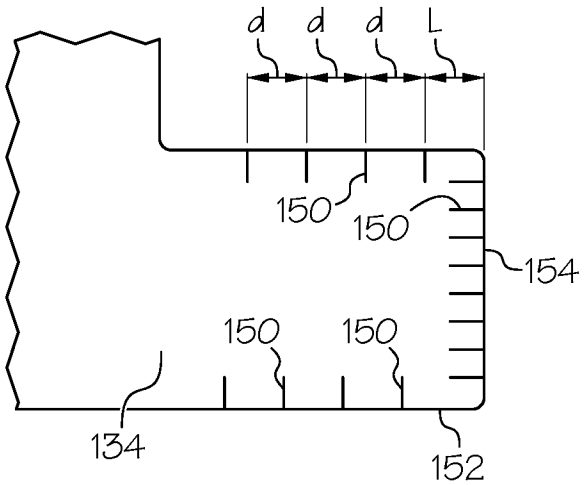
FIG. 6 shows a detailed view of a portion of the third plate of FIG. 1 in accordance with an exemplary embodiment of the invention.

Referring now to FIGS. 6 and 7, there is illustrated an exemplary embodiment, of a front side of the brazing tabs 132 and a back side of the tab 134 configured with a constraining system for precluding undesired migration of molten brazing material from a position between adjacent ones of the brazing tabs. The tabs 132 and 134 may be provided with constraining grooves 150 formed in outer surfaces of the brazing tabs 132 and 134. The grooves may be spaced around outer peripheries 152 of the tabs 132 and 134 and may be oriented substantially orthogonally to the outer peripheries 152. In an exemplary embodiment, the grooves 150 may be stamped or embossed into the outer surfaces of the brazing tabs 132 and 134. The grooves 150 may be about 0.002 inches to about 0.005 inch deep, 0.010 inch to about 0.020 inch long and about 0.005 inch to about 0.008 inch wide. When molten brazing material flows across a surface of one of the tabs 132 or 134 and approaches the outer periphery 152 of the tab, the grooves 150 may wick the molten brazing material and thus preclude migration of the molten material beyond the outer periphery 152. The grooves 150 may be spaced sufficiently close to one another so that wicking action may occur. The grooves 150 may be long enough and deep enough so that they may effectively act as reservoirs for excess molten brazing material.

In an exemplary embodiment the tabs may have a width and a length of about 0.25 inch. Thus the outer periphery may have an overall length of about 0.75 inch. Each of the tabs 132 and 134 may be provided with about 16 to about 20 of the grooves 150. It may be noted that some of the grooves 150 of the tab 132 may be offset from some of the grooves 150 of the tab 132. In an exemplary embodiment, a first one of the grooves 150 of a front side of the tab 134 may be spaced a distance L from a free end of the tab 134. Other grooves 150 of the tab 134 may be spaced apart by a distance d. A first groove 150 of a back side of the tab 132 may be spaced a distance L+d/2 from a free end 154 of the tab 132. Other grooves of the tab 132 may be spaced apart a distance d.

Figure 8:
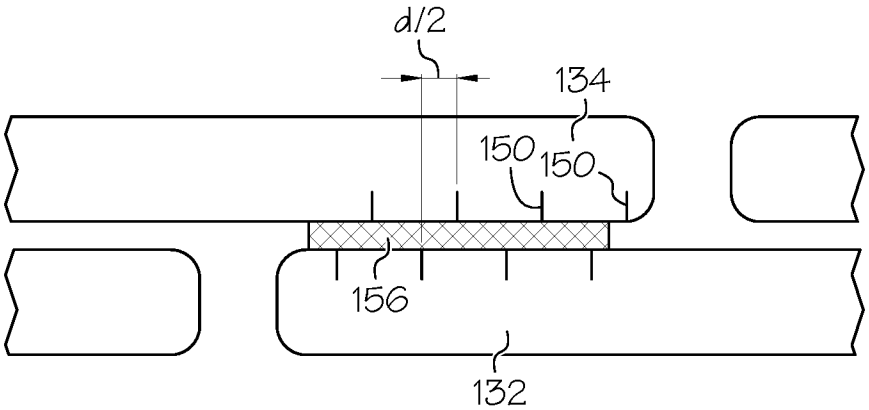
FIG. 8 is a schematic illustration of overlapping brazing tabs of the third plates of FIG. 1 in accordance with an exemplary embodiment of the invention.

Referring now to FIG. 8, it may be seen that when the tabs 132 and 134 overlie one another, the grooves 150 may be offset from another and respective spacing.

Figure 9:
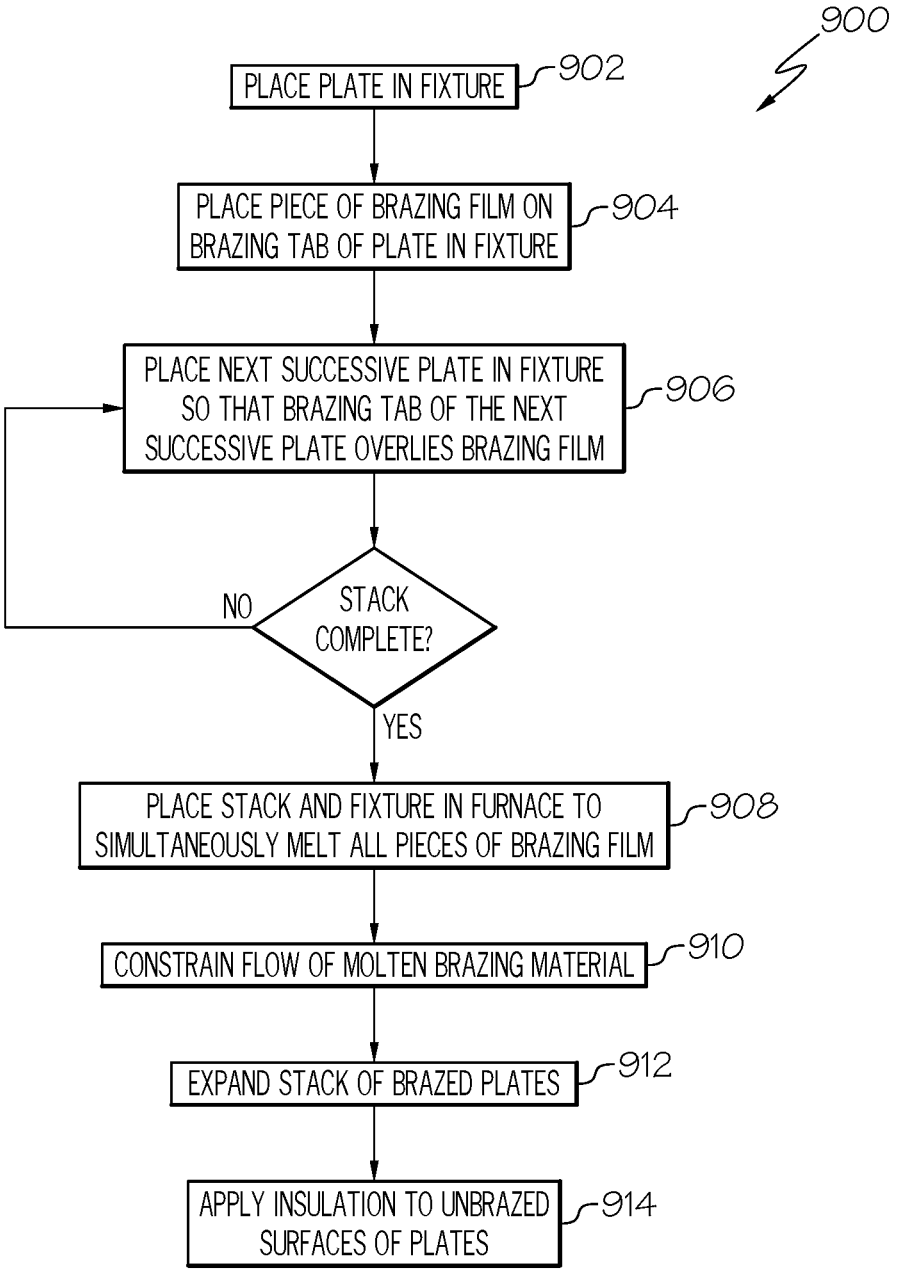
FIG. 9 is a flow chart of a method fabricating a coil of stacked single pattern plates as shown in FIG. 1.

Referring now to FIG. 9, a flow chart illustrates an exemplary embodiment of a method 900 for producing a winding or coil. In a step 902, a plate may be placed in a fixture (e.g. one of the plates 105, 110 or 115 may be placed in or on a supporting fixture [not shown]). In a step 904, a piece of brazing film may be placed on a brazing tab of the plate (e.g. brazing film 156 may be placed on brazing tab 132 or 134). In a step 906, a next successive plate may be placed in or on the fixture so that the brazing tab of the next successive plate overlies the piece of brazing film. Steps 904 and 906 may be successively repeated until a stack of the plates is complete.

In an exemplary embodiment, step 906 may be repeatedly performed by successively placing a front side of one of the plates into contact with a back side of one of the plates. For example, one or of plates 115 may be positioned in the fixture with its front side 116 exposed. Another one of the plates 115 may then be placed in the fixture with its back side 118 exposed. In other words, the plates 115 may be successively placed in the fixture with each successive plate having alternating front to back orientations.

In a step 908, a weight (not shown) may be placed on the completed stack to hold the plates together and the plates and the holding fixture may be placed in a furnace (not shown) to simultaneously melt all pieces of the brazing film. In a step 910, flow of molten brazing material may be constrained (e.g. grooves 150 in the brazing tabs 132 or 134 may capture portions of the molten brazing material as the molten brazing material reaches outer peripheries 152 of the brazing tabs 132 or 134. Thus brazing material may be constrained to remain between adjacent ones of the brazing tabs 132 or 134).

Figure 10:
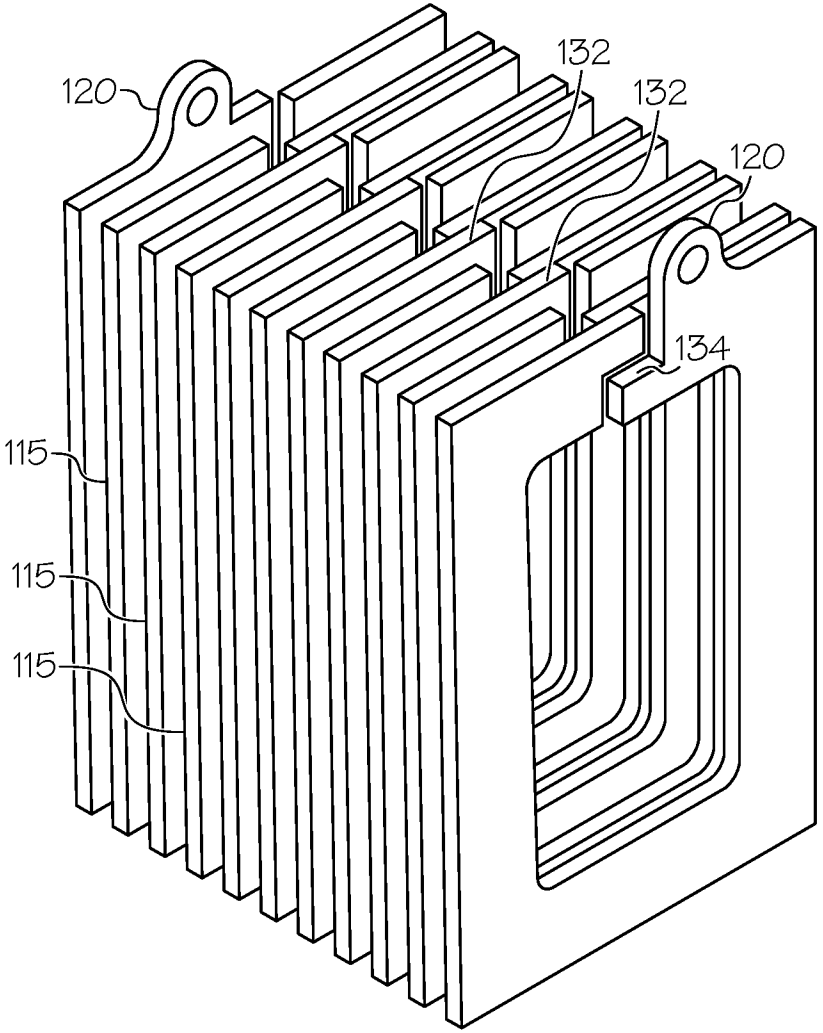
FIG. 10 is an illustration of a stack of plates of FIG. 1 shown in an expanded state in accordance with an exemplary embodiment of the invention.

In a step 912, the brazed stack of plates may be expanded as shown in FIG. 10. In a step 914, electrical insulation may be applied to unbrazed surfaces of the plates (e.g., the plate surfaces may be anodized, powder coated or varnished). After application of electrical insulation in step 914, the stack may be compressed into a configuration such as that illustrated in FIG. 1.

The method 900 may provide a winding which may be assembled without a need to perform numerous successive electrical connection and insulation steps. For example, the invention may preclude a need to successively perform separate steps such as placing an insulating material on a first plate; followed by placing a second plate on the insulating layer, followed by soldering or brazing the first to the second plate; followed by repeated separate insulating and soldering or brazing steps for a successive collection of n plates.

It may be noted that, the brazed stack of plates may utilized as a resistance heater if the stack is expanded (i.e., step 912) and if insulation is not applied to the unbrazed surfaces of the plates (i.e., step 914).

It should be understood, of course, that the foregoing relates to exemplary embodiments of the invention and that modifications may be made without departing from the spirit and scope of the invention as set forth in the following claims.

We claim:

1. A method for producing a winding, comprising:

forming a plurality of metal plates, each plate having brazing tabs;

forming grooves in surfaces of the brazing tabs;

applying a brazing material to a first brazing tab of a first one of the plurality of metallic plates;

positioning a second one of the plurality of metallic plates so that a second brazing tab of the second one of the plurality of metallic plates contacts the brazing material and wherein each of the grooves of the first brazing tab of the first one of the metallic plates is opposed and offset to each of the grooves of the second brazing tab that oppositely faces the first brazing tab;

simultaneously heating the plurality of metallic plates and the brazing material; and constraining flow of brazing material between adjacent ones of the brazing tabs using the grooves.

2. The method of claim 1 wherein the step of constraining flow of brazing material is performed by wicking excess molten brazing material into the grooves formed in the surfaces of the brazing tabs.

3. The method of claim 1 further comprising the steps of:

expanding the brazed stack of plates to separate unbrazed portions of the plates;

applying electrical insulating material to the unbrazed portions of the plates; and pressing the expanded plates together so that insulated portions of any one of the plates is in contact with insulated portions of an adjacent one of the plates.

4. The method of claim 3 wherein the step of applying insulating material comprises anodizing the unbrazed portions.

5. The method of claim 3 wherein the step of applying insulating material comprises applying powder coating to the unbrazed portions.

* * * * *